United States Patent [19]

Marquardt

[11] Patent Number: 4,746,778

[45] Date of Patent: May 24, 1988

[54] CIRCUIT BREAKER WITH AN ACTUATING DEVICE AND AN ENERGY ACCUMULATOR

[75] Inventor: Ulrich Marquardt, Berlin, Fed. Rep. of Germany

[73] Assignee: Siemens Aktiengesellschaft, Munich, Fed. Rep. of Germany

[21] Appl. No.: 935,040

[22] Filed: Nov. 26, 1986

[30] Foreign Application Priority Data

Nov. 29, 1985 [DE] Fed. Rep. of Germany ..... 3542746

[51] Int. Cl.[4] ..... B21J 5/06; H05B 1/00

[52] U.S. Cl. ..... 200/153 SC; 200/153 G; 335/26; 335/194

[58] Field of Search ..... 335/26, 27, 194; 200/153 SC, 153 G

[56] References Cited

U.S. PATENT DOCUMENTS

| | | | |
|---|---|---|---|
| 3,073,929 | 1/1963 | Hauser | 200/106 |
| 3,171,938 | 3/1965 | Pokorny | 200/153 |
| 4,163,133 | 7/1979 | Bould | 200/153 |
| 4,475,021 | 10/1984 | Mochizuki | 200/153 SC |

FOREIGN PATENT DOCUMENTS 0088215 9/1983 European Pat. Off. .

*Primary Examiner*—H. Broome
*Assistant Examiner*—Lincoln Donovan
*Attorney, Agent, or Firm*—Kenyon & Kenyon

[57] ABSTRACT

An energy accumulator for a circuit breaker comprises a cross piece which can be inserted between side walls of the support mechanism of the circuit breaker, which has a substantially U-shaped cross section and against the center part of which coil compression springs are braced. With their opposite ends, the springs rest against a movable abutment which likewise has a U-shaped cross section. A push rod which goes through one of the springs in its longitudinal direction is guided in the cross piece and has a transverse hole for inserting a securing pin in the partially cocked state of the springs. Between the legs of the cross piece there are inserts which have an extension pointing in the direction of the movable abutment. Thereby, a space for the engagement of a leg of the movable abutment is formed if the springs are tensioned more heavily.

5 Claims, 3 Drawing Sheets

CIRCUIT BREAKER WITH AN ACTUATING DEVICE AND AN ENERGY ACCUMULATOR

BACKGROUND OF THE INVENTION

The present invention relates to a circuit breaker with an actuating device and an energy accumulator which contains at least one spring, is braced against a support mechanism of the circuit breaker and comprises a push rod serving for introducing a tensioning force and for passing-on the accumulator force.

A circuit breaker of this type has become known, for instance, from European Pat. No. EP-A-0 088 215. The spring is realized there as a compression coil spring, the turns of which enclose two guide rods which can be moved relative to each other in the longitudinal direction of the spring and of which one acts as a push rod in the direction of the actuating parts of the circuit breaker while the other guide rod serves for bracing and holding the spring arrangement against the support mechanism of the circuit breaker. To this end, a bolt, for the passage of which an opening in the support mechanism of the circuit breaker is provided, is connected to the further guide rod. The spring arrangement can be fastened by a pin which can be inserted on the back side of the support mechanism into a transverse hole of the bolt.

The installation of an energy accumulator of this type in a circuit breaker makes it necessary to mount the compression springs on the guide rods and to fasten this arrangement by means of the bolt and the transverse pin to the support mechanism of the circuit breaker.

Subsequently the spring must be tensioned so that the spring arrangement can be brought into engagement with the actuator parts. This process is difficult to carry out because, due to the compact design of modern circuit breakers, only little space is provided for the engagement of fixtures or tools. On the other hand, there is the danger of damaging or injuring already built-in parts of the circuit breaker if an error is made when tensioning the springs due to poor accessibility and the spring slips off the tool or fixture used before the spring force is safely intercepted.

SUMMARY OF THE INVENTION

It is an object of the present invention to correct the present limitations and dangers in connection with tensioning the energy accumulators of circuit breakers.

According to the invention, the above and other objects are achieved by the provision that the energy accumulator is designed as a self-contained subassembly comprising a stationary abutment, a movable abutment as well as a push rod, where the stationary abutment is designed as a cross piece which can be inserted between side walls of the support mechanism of the circuit breaker and can be connected to the side walls. By this design, the energy accumulator can be manufactured independently of the other components of the circuit breaker. Since this now involves a relatively small and highly accessible subassembly, no difficulties are encountered in tensioning the spring in a fixture, all conditions for simple handling and completely safe execution of the process being provided. An important contribution to this is the fact that the stationary abutment of the spring is designed as the cross piece of the support mechanism of the circuit breaker and is therefore laid out not only in accordance with the stresses by the spring forces but also with the forces to be transmitted via the side walls, and thus represents a structural part of great strength.

The desired great strength of the cross piece can be achieved with a comparatively small amount of material by the provision that the cross piece has a U-shaped profile, the central part of which forms a contact surface for the spring, and the legs of which extend approximately parallel to the longitudinal axis of the spring. Also, the movable abutment of the spring can have a U-shaped profile with legs extending parallel to the longitudinal axis of the spring, where at least one leg of the cross piece and the movable abutment are designed at least partially overlapping if the spring is tensioned. Thereby, a certain degree of mutual alignment of the abutments is achieved, which is useful particularly if several parallel springs are used instead of a single spring, and this arrangement has a tendency that the abutments are twisted relative to each other.

To reinforce the cross piece with the U-shaped profile further, inserts can be connected to its legs, each of which has an extension in the direction of the movable abutment which is designed with a spacing from at least one of the legs of the cross piece. In this manner, guiding surfaces are formed which engage the movable abutment upon approaching the cross piece when the spring or springs are tensioned, and effectively limit the mutual twisting of the parts.

The springs can be secured in the tensioned condition in a simple manner by the provision that the cross piece has an opening for an end section of the push rod, a hole for receiving a securing member being provided in the end section if the spring is approximately tensioned as in operation. It is advisable in this connection to choose a somewhat smaller tension of the spring or the springs than corresponds to the full operational tension, since it presents no difficulty to effect the remaining spring stroke after installation of the energy accumulator into the circuit breaker by means of its actuating device. Then, the securing member can be lifted off the cross piece and can then be removed without danger and without special tools, whereby the breaker is made ready for operation.

BRIEF DESCRIPTION OF THE DRAWINGS

The invention will be explained in greater detail in the following detailed description with reference to the drawings, in which.

DETAILED DESCRIPTION

Figure 1:
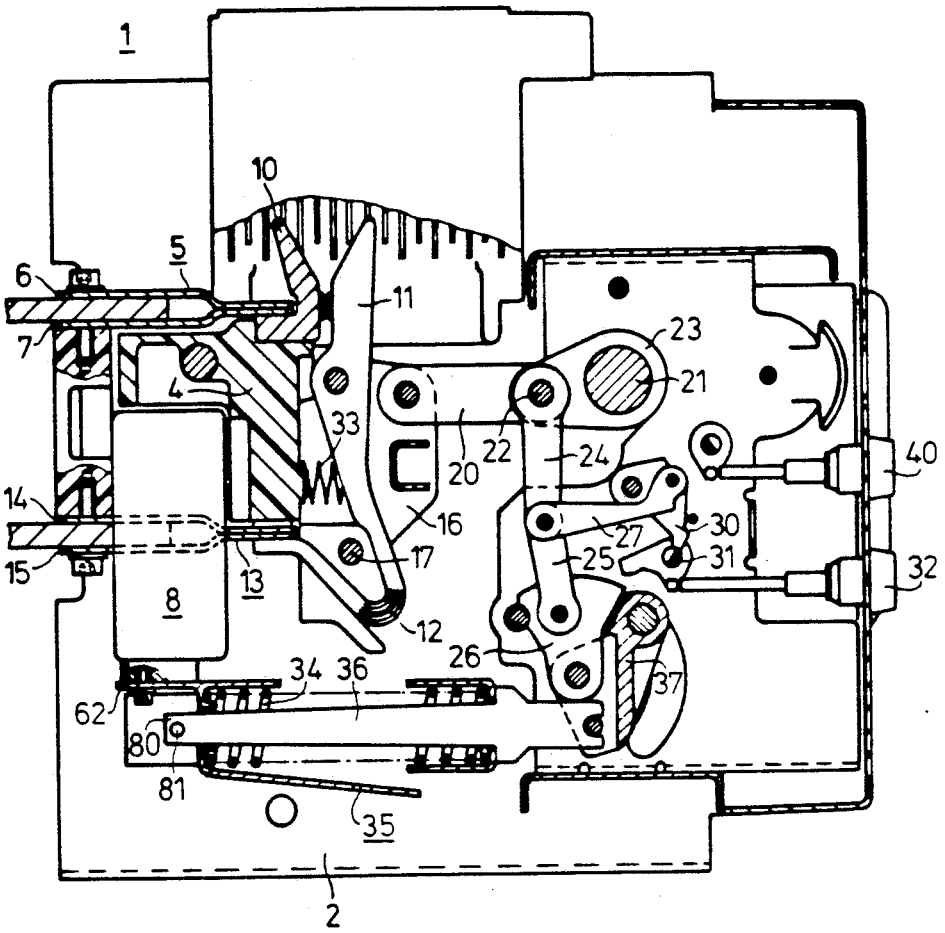
FIG. 1 shows a low-voltage circuit breaker in a cross section.
Figure 5:
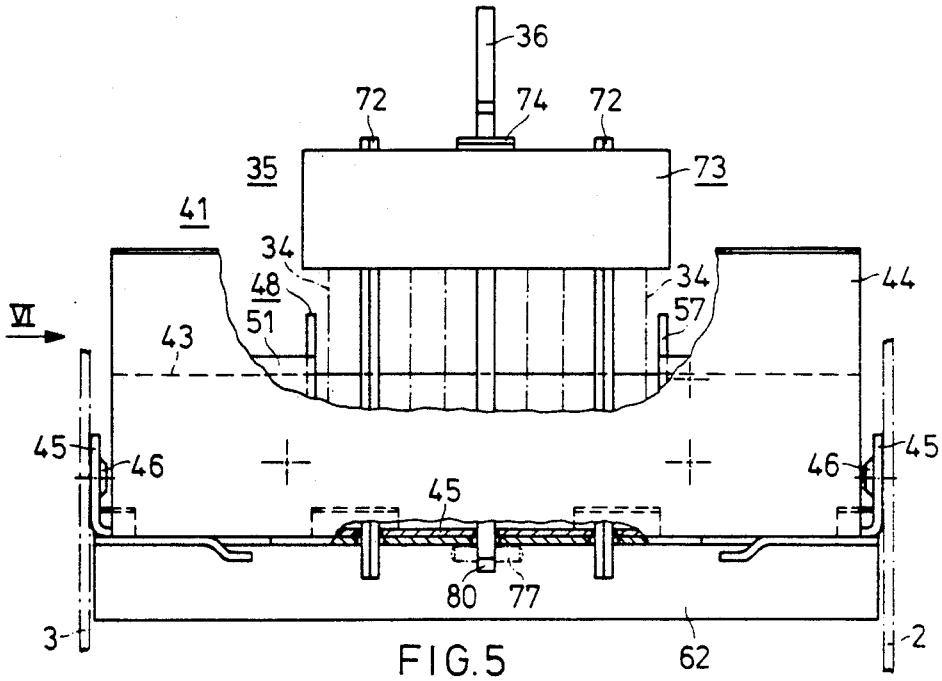
FIG. 5 shows a complete energy accumulator.

The low-voltage circuit breaker 1 depicted in FIG. 1 is shown simplified as a section through a pole and the switching mechanism. The circuit breaker 1 has as supporting components two side walls 2 and 3, of which the one side wall 2 is visible in FIG. 1, while both side walls 2 and 3 are indicated in FIG. 5. An insulating support 4 for three adjoining contact arrangements extends between the side walls 2 and 3. The current path of each pole comprises, starting from an upper forked bus bar 5 with sectional bars 6 and 7, a stationary contact 10, a movable switching lever 11, a flexible current-carrying ribbon 12 as well as the lower contact bar 13 which is likewise composed of sectional bars 14 and 15. The contact lever 11 is pivoted at a contact carrier 16 which can be tilted about a stationary pivot 17. A control shaft 21 supported in the side walls 2 and 3 engages the contact carrier 16 with the interposition of an insulating coupling rod 20. At the connecting joint 22 between the control shaft 21 or a lever 23 mounted thereon and the coupling rod 20 engages a toggle switch arrangement of three toggle levers 24, 25 and 26 which are flexibly connected to each other and which, in the on-position of the circuit breaker shown is supported by a support lever 27 and a ratchet lever 30 against a half-shaft 31. Rotation of the half shaft 31 by a tripping device, not shown, or by hand through a push-button 32 cancels the support of the toggle lever system and causes the latter to buckle. The contact carrier 16 and the contact lever 11 are then transferred into the off-position under the influence of a compression spring 33.

The energy required for closing the switch is stored in a manner not shown in detail by cocking one or more coil pressure springs 34 which are part of an energy accumulator 35 which is fabricated as a separate structural unit and is shown simplified in FIG. 1. A push rod 36 of the energy accumulator 35 is connected to a driver lever 37 which transmits the spring force to the lower toggle lever 26. The compression springs 34 can be latched in the cocked condition in a manner known per se, a further push button 40 being provided for releasing this latch and thereby, for closing the circuit breaker.

Figure 2:
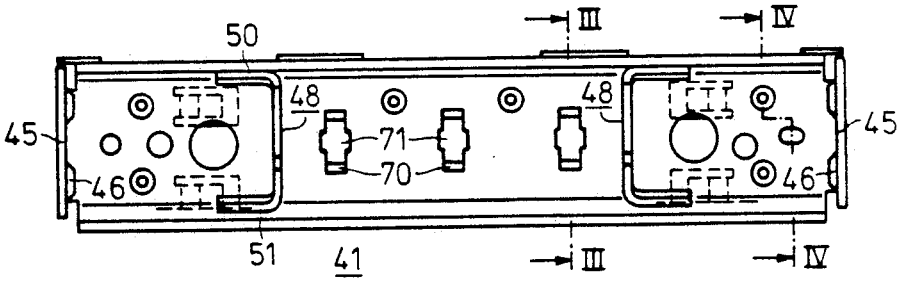
FIG. 2 shows a cross section of an energy accumulator as an individual part.
Figure 3:
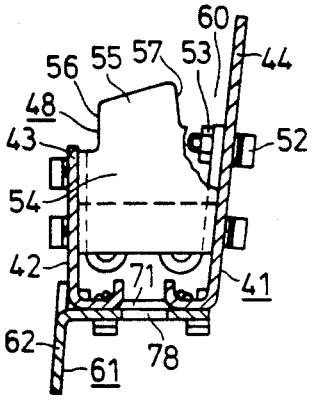
FIGS. 3 and 4 show the cross sections III—III and IV—IV in FIG. 2
Figure 4:
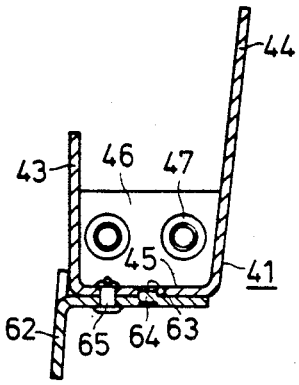

The design of the energy accumulator 35 will be explained in detail in the following, making reference to FIGS. 2 to 6. A cross piece 41 which is shown as an individual part in the view of FIG. 2 serves as the supporting main part of the energy accumulator 35. Cross sections of the cross piece 41 in the planes indicated in FIG. 2 are shown in FIGS. 3 and 4.

The cross piece 41 has a substantially U-shaped main body 42 which is made of sheet steel and the legs 43 and 44 of which have different lengths. The leg 43 which is situated on top in the installed position according to FIG. 1 is shorter than the lower leg 44 and is approximately at right angles to the central part 45. The leg 44, on the other hand, occupies a somewhat larger angle relative to the central part 45. The purpose of this design will be explained later on. At both ends, the cross piece 41 has tightening pieces 46 which are provided with funnel-shaped holes 47. The tightening piece 46 may be integral with the main body 42. Between the legs 43 and 44 are further placed inserts 48, the shape of which is best seen in FIGS. 2 and 3. As will be seen, each insert 48 has two legs 50 and 51, the angular position of which is matched to the legs 43 and 44 of the main body 42. In view of the purpose of the inserts 48 to stiffen the legs 43 and 44 relative to each other, the leg 51 of each insert 48 is made longer, corresponding to the greater length of the associated leg 44. The legs 50 and 51 of the inserts 48 rest against the legs 43 and 44 and are connected to them by screws 52 and nuts 53 in those places.

The central part 54 of each insert 48 forms an extension which extends toward the open side of the U-profile of the main body 42 and the edges 56 and 57 of which are at an angle relative to each other. As is shown particularly in FIGS. 3 and 5, a space 60 which is tapered in wedge fashion is formed between the leg 44 and the edge 57 by this design.

To the central part 45 of the main body 43 is connected an angular section 61 which has bracket 62 which approximately continues the leg 43 toward the back of the circuit breaker 1. A dimensionally correct cohesion is achieved by interlocking pins 63 and holes 64 as well as rivets 65. The angular piece 61 and the inserts 48 stiffen the U-profile in such a manner that in spite of a relatively small amount of material and weight extraordinarily great strength of the cross piece against flexing and torsion is achieved. The bracket 62 serves at the same time as a support of a current transformer 8 shown in FIG. 1.

In the embodiment shown, the energy accumulator 35 contains three coil compression springs 34 arranged parallel to each other. These are braced with their one end against the central part 44 of the cross piece 41. The springs 34 are given the desired mutual spacing by three pairs of tabs 70 which are pushed out of the central part 44 of the base body 42. At the same time, openings 71 for the push rod 36 as well as two guiding rods 72 are formed. The angular piece 61 is provided with corresponding openings 78 (FIG. 3). The guiding rods 72 are made shorter than the push rod 36 and merely serve for preventing lateral bending of the springs 36. The guiding rods 72 and accordingly, the laterally arranged cutouts 71 can be omitted if the springs 34 do not have a tendency to bend laterally or to buckle, depending on their dimensions.

Figure 6:
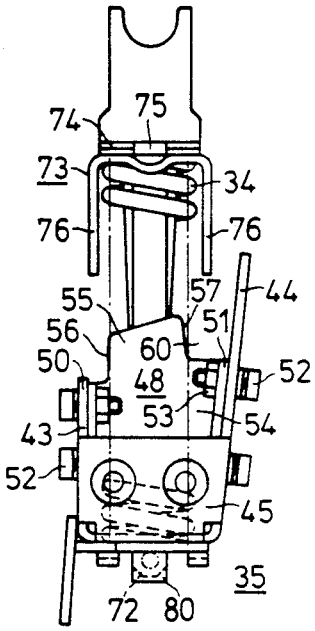
FIG. 6 shows a side view of the energy accumulator according to FIG. 5 in the direction of the arrow VI.

At the end opposite the cross piece 41, the springs 34 are braced against a movable abutment 73 which, according to FIG. 6, has a U-shaped cross section and the central part of which is provided with projections 75 for centering the springs 34. A cross piece 74 of the push rod 36 serves for transmitting the spring forces. The legs 36 of the abutment 73 extend in the direction toward the cross piece 41 and are designed so that the one of the legs 76 of the abutment 73 is in an overlapping position with the longer leg 44 of the base body 42 if the springs 34 are pretensioned and are secured in this position. This can be accomplished by the provision that on the back of the cross piece 41, a securing pin 77 (FIG. 5) is inserted at the backward end section 80 of the push rod 36. By this overlap, which can be seen particularly from FIG. 6, it is avoided that the abutment 73 can twist relative to the cross piece 41 under the influence of not perfectly equal spring forces.

Figure 7:
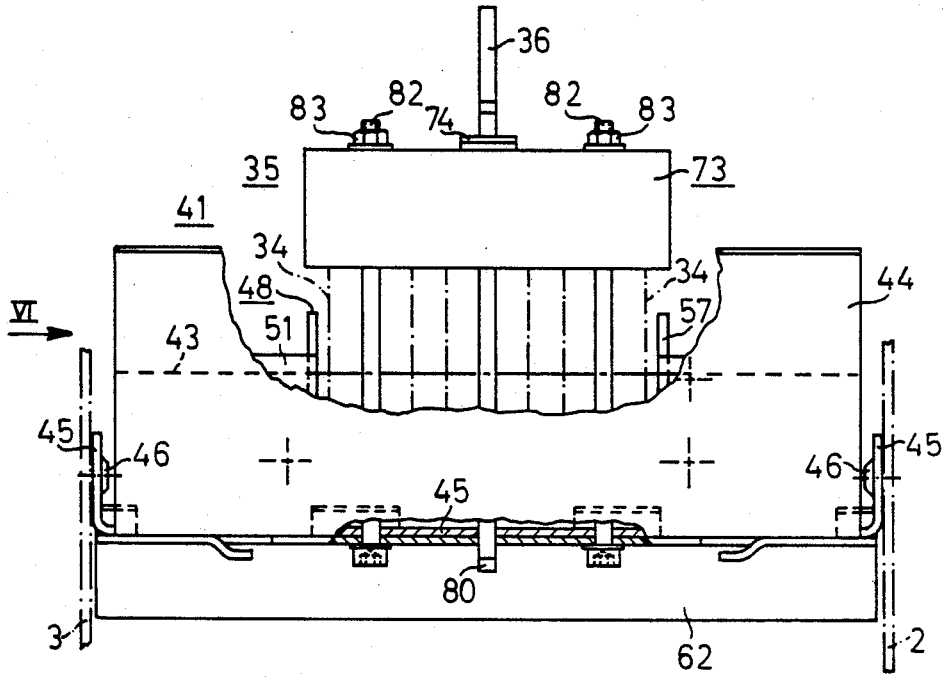
FIG. 7 shows a modified embodiment of an energy accumulator in a view corresponding to FIG. 5.

The springs 34 can be secured in the cocked position also in a modified manner as is shown in FIG. 7. There, the guide rods 72 in FIG. 5 are replaced by screws or studs 82, onto the protruding ends of which nuts 83 are screwed. This arrangement is particularly well suited for larger spring forces, for controlling which a cross pin according to the cross pin 77 in FIG. 5 would assume inaccurate measurements.

The energy accumulator 35 shown in FIGS. 5 and 6 is an independent subassembly which can be secured in the tensioned condition in a simple manner by a simple fixture after it is assembled and can be secured by putting the securing pin in place in the tensioned condition. When installed in the circuit breaker 1 according to FIG. 1, the cross piece 41 becomes a part of the support mechanism of the circuit breaker so that this cross piece executes not only the function of a stationary abutment of the compression coil springs 34 but also contributes to the strength of the support mechanism of the circuit breaker. To this end, the cross piece 21 is connected by means of the holes 46 to the side walls 2 and 3 (FIGS. 1 and 5) by screws or similar fastening means. It presents no difficulties to bring the push rod 36 into engagement with the driver rocker 37 (FIG. 1) because the push rod has a position suitable therefor due to the pretension of the springs 34. Starting therefrom, the springs 34 can be cocked in a manner known per se by means of the actuating device of the circuit breaker, where the push rod 36 passes farther through the corresponding cutouts 71 and 78 of the cross piece 41 and the securing pin 77 can be removed. Similarly, the push rod 36 can be secured again by inserting the securing pin 77 if the spring accumulator is to be disassembled from the circuit breaker 1.

The already mentioned position of the leg 44 of the base body 42, deviating from a right angle, makes possible a sufficiently large tilting angle of the springs 34 if the crank arm 37 is rotated in the operation of the circuit breaker 1. The wedge-shaped form of the space 60 insures that the movable abutment 73 and the cross piece 41 are aligned with respect to each other for all occurring motions.

The description above shows that the described energy accumulator 35 is suited for receiving a spring 36 or two or three springs 36. In this manner, the required energy supply for different circuit breakers can be made available. In addition, it is possible merely by using longer cross pieces 41 and movable abutments 73 to accommodate an even larger number of springs. The push rod 36 as well as the inserts 48 remain unchanged here.

It can further be seen that the energy accumulator 35 is not bound to a given design of a circuit breaker. The cross piece and the push rod 36 should rather be considered as transition parts (adapters), whereby the energy accumulator is suitable for other switchgear, for instance, medium-voltage load and power circuit breakers.

In the foregoing specification, the invention has been described with reference to specific exemplary embodiments thereof. It will, however, be evident that various modifications and changes may be made thereunto without departing from the broader spirit and scope of the invention as set forth in the appended claims. The specification and drawings are, accordingly, to be regarded in an illustrative rather than in a restrictive sense.

What is claimed is:

1. An energy accumulator adapted to be used within a circuit breaker, the circuit breaker comprising a support structure including side walls and an actuating device cooperating with said energy accumulator, the energy accumulator being an independent subassembly comprising at least one spring, a push rod for introducing a tensioning force on said spring or for applying a force accumulated in the spring to the actuating device of said circuit breaker, a stationary abutment for said spring being provided comprising a cross piece dimensioned to fit in the space between said side walls of said circuit breaker and means for keeping said spring in a cocked position approximately as in operation while said subassembly is not connected to said circuit breaker, whereby said energy accumulator can be inserted into and removed from said circuit breaker when said spring is in the cocked position.

2. The energy accumulator recited in claim 6, wherein the cross piece has a U-shaped profile, the center part of which forms a contact surface for the spring and the legs of which extend approximately parallel to the longitudinal axis of the spring.

3. The energy accumulator recited in claim 2, further comprising a movable abutment having a U-shaped profile with legs extending parallel to the longitudinal axis of the spring, at least one leg of the cross piece and of the movable abutment at least partially overlapping if the spring is tensioned.

4. The energy accumulator recited in claim 3, wherein inserts are connected to the legs of the cross piece which reinforce the cross piece against bending forces and each insert has an extension in the direction of the movable abutment disposed at a spacing from at least one of the legs of the cross piece, said inserts being disposed between the legs of the cross piece and said spacing being provided to receive a leg of the movable abutment during cocking of the spring.

5. The energy accumulator recited in claim 2, wherein the cross piece has an opening for an end section of the push rod and a hole is arranged in the end section of the push rod for receiving a securing member with the spring cocked approximately as in operation so that the energy accumulator can be inserted into or removed from the circuit breaker in its cocked position.

* * * * *